United States Patent [19]

Bruno

[11] Patent Number: 4,709,400

[45] Date of Patent: Nov. 24, 1987

[54] PRODUCE BAG WITH TIE TAILS

[76] Inventor: Edward C. Bruno, 15336 Penwood Pl., Aurora, Colo. 80015

[21] Appl. No.: 865,753

[22] Filed: May 22, 1986

[51] Int. Cl.[4] ..... B65D 33/16

[52] U.S. Cl. ..... 383/77; 383/63; 383/118

[58] Field of Search ..... 383/77, 63, 118

[56] References Cited

U.S. PATENT DOCUMENTS

| | | | |
|---|---|---|---|
| 3,245,606 | 4/1966 | Crane | 383/118 |
| 4,020,884 | 5/1977 | Jadot | 383/63 |
| 4,445,230 | 4/1984 | Spadaro | 383/77 |

*Primary Examiner*—Willis Little

*Attorney, Agent, or Firm*—Leo J. Aubel; Ralph R. Rath

[57] ABSTRACT

Produce bags (11) formed of plastic, the panels or sides (15, 16) of the bag being slitted to enable produce contained in the bag to be ventilated; the bags further including tails (25, 26) for enabling convenient secure closure of the bag.

8 Claims, 8 Drawing Figures

FIG. 1
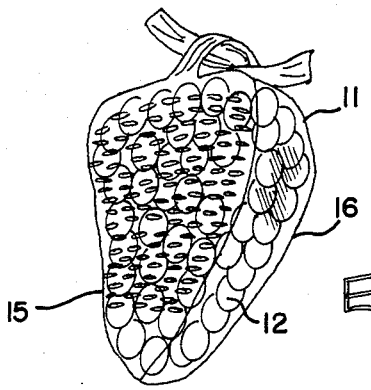
FIG. 5
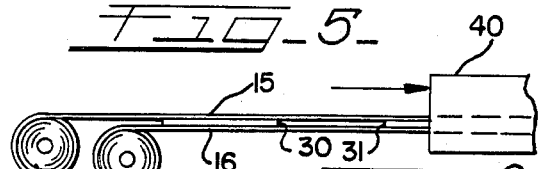
FIG. 6
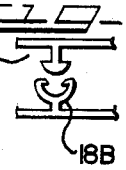
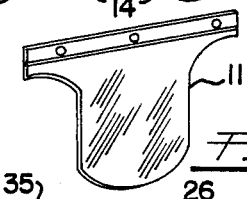
FIG. 2
FIG. 3
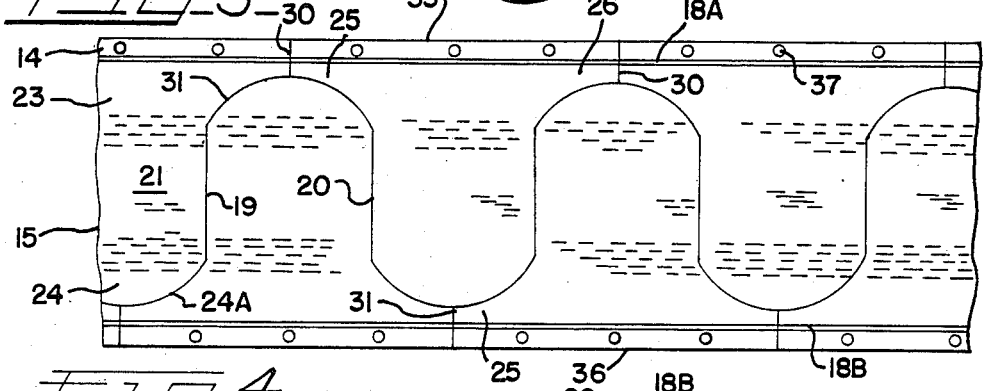
FIG. 4
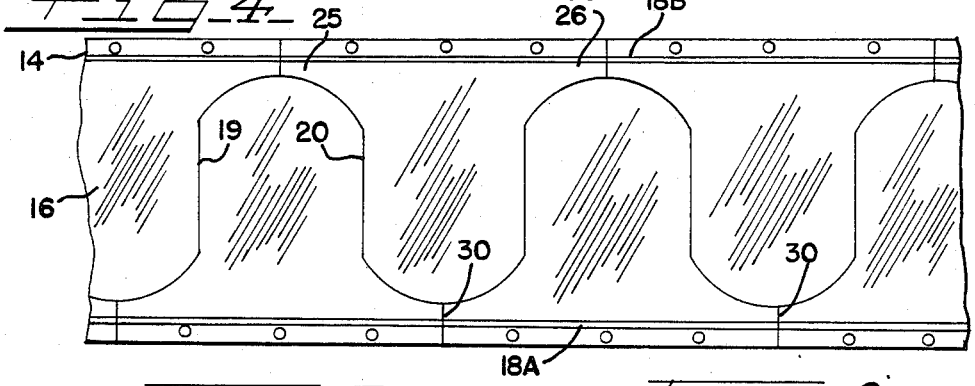
FIG. 7
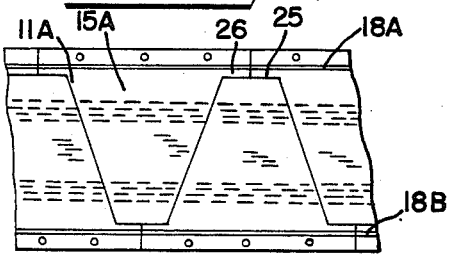
FIG. 8
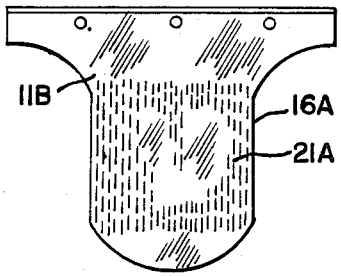

PRODUCE BAG WITH TIE TAILS

TECHNICAL FIELD

This invention relates generally to bags made from a sheet of thin pliable plastic film, particularly for packaging produce such as grapes.

BACKGROUND OF THE INVENTION

Prior art bags for packaging produce are slit for the purpose of allowing air to circulate into the bag for ventilation of the produce packed therein, and also to enable ready expansion and conformity of the bag to the product.

The present invention is related to U.S. Pat. Nos. 3,245,606 and 4,503,561, which disclose bags for packing produce, such as berries, grapes, and the like. The bags disclosed therein are formed to have two facing or opposite panels or sides of pliable plastic sheet for film. In U.S. Pat. No. 3,245,606 one or the first panel includes vertical slits arranged in parallel rows. Each row of slits is longitudinally spaced from adjacent rows; and the slits in alternate rows are aligned in directions transversely of the slits, and the slits in adjacent rows are offset from one another. In U.S. Pat. No. 3,245,606 the other or opposite panel is solid. The solid or unslitted panel functions to limit the stretching of the bag.

In U.S. Pat. No. 4,503,561, the bag comprises one panel which includes vertical slits similar to those of the first panel of the bag in U.S. Pat. No. 3,245,606 and the other panel includes horizontal slits in parallel rows with each row of slits spaced from adjacent rows; and the slits in alternate rows are aligned in directions transversely of the slits, and the slits in adjacent rows are offset from one another. The slits in said other or opposite panel are substantially perpendicular or normal to the slits in the one or first panel.

The bags of the cited patents have tapered sides, open tops, and straight or rounded bottoms. In use, the bags are filled with produce such as grapes, and next the open end of the bag is tied either by wire ties, or the top of the bag is tied on itself. In the latter operation the filled bags are spun on a horizontal axis to create tie tails at the open end of the bag forming tails are then tied into a knot.

SUMMARY OF THE INVENTION

A recloseable plastic bag includes the provision of two panels with portions of each panel extending outwardly from adjacent the open end or top of bag. The extending portions provide a double thickness tail for tying the bag. No twisting, gathering or spinning of the bag is necessary to form a tying extension; hence the tying operation is expedited. In addition, more produce can be placed in a bag of the equivalent size because the holding or container portion of the bag does not need to form a tie portion.

In one preferred embodiment of the invention, the bags include interlocking tongue and groove mating profiles, of the type shown in the art, such as in expired U.S. Pat. No. Re. 29,208. The foregoing features and advantages of the present invention will be apparent from the following more particular description of the invention. The accompanying drawings, listed hereinbelow, are useful in explaining the invention wherein.

DESCRIPTION OF THE DRAWINGS

FIG. 1 shows the inventive bag with produce contained therein.

FIG. 2 shows the inventive bag with the mating profiles closed and the tie tails not tied.

FIG. 3 is a top view of the sheets indicating the method of production;

FIG. 4 is a top view of the second sheet indicating the method of production.

FIG. 5 indicates generally the method of overlapping of two sheets of plastic film to make the inventive bag.

FIG. 6 is an enlarged top view of the mating profiles of the inventive bag.

FIG. 7 shows a second embodiment of the invention, and

FIG. 8 shows another embodiment of the invention.

DESCRIPTION OF THE INVENTION

FIG. 1 shows a packaging bag 11 in accordance with the invention and containing produce 12, such as grapes, therein. The bag 11 is made from thin, pliable plastic film 14 fabricated as two panels 15 and 16, see FIGS. 3 and 4. The panels 15 and 16 are formed and joined such as by heat sealing and severing the bag in a pattern along the two side edges and the bottom edge of the bag. The panels 15 and 16 include respective interlocking or mating profiles 18A and 18B (see also FIG. 6) of any suitable known design adjacent the reclosable end or mouth of the bag 11 for purposes of closing the bag mouth, as stated above.

Panel 15 is slit with a slit pattern 21 as described above with reference to the prior art patent while panel 16 is solid. The top section 23 and bottom section 24 of panel 15 are solid to provide a strong portion that does not expand, and which imparts strength to the panel and the bag.

The slit pattern 21 of panel 15 will open in a vertical direction to receive the contents and conform closely to the contents placed adjacent thereto but will not stretch or open in a horizontal direction.

In the embodiment of the invention shown in FIG. 3 of the drawings, the panels 15 and 16 are formed to have substantially straight sides 19 and 20, and a round or arcuate bottom 24A. It has been found that this form of the bags provides a smooth, even enclosure around the produce, see FIG. 1. The round bottom tends to conform to the shape of the grape cluster.

As shown in the drawings, each of the panels 15 and 16 include an outwardly extending portion generally labeled 25 and 26 at the respective open or top of the bag, which forms the tie tails. The side edges 30 of the panels 15 and 16 are joined as by heat sealing to provide double thickness portions forming tie tail 25 and 26; this provides relatively stronger tie portions. The opening or mouth of each bag 11 along the edges 35 of the film 14 is relatively wider than the body portion of the bag between the rectangular sides 19 and 20 to readily accept the produce. The packer can quickly and efficiently insert the produce in the bag and tie the bag as shown in FIG. 1. Thus facility, efficiency and quickness in bagging the produce is attained. No separate additional ties are required.

The plastic film for making the bag may be extruded from an extruder as a tubular film with the tongue (rib) and groove mating profiles 18A and 18B formed thereon, as is well known in the art as shown in FIG. 6. The extruded tube is then slit to form the flat open sheets of film, all shown, for example, in Japanese Patent Publication No. 2743/1956 to Noguchi.

As indicated in FIG. 5, the bags 11 are formed or made from two overlayed sheets of plastic film 14 which are moved onto a table or bed which is part of a bag-making equipment 40, of any suitable known type for making bags from a moving sheet of film.

In one method of production, a sheet of film 14 for forming panels 15 is processed to have the slit pattern 21, as is known in the art cited above. Next, and as indicated in FIG. 5, the sheet of film 14 forming the panels 15 is overlayed over a sheet of film 14 for forming the solid panels 16. The mating profile on panels 15 is aligned with groove profile 18B of panels 16.

As is common, the sheet is caused to move in a path indicated by the arrow of FIG. 5 through the bag-making equipment 40 of suitable known type. The two panels 15 and 16 of each bag are heat sealed, scored and severed along the lines generally indicated as 19, 20, 30 and 31 to form the edges of the bags 11.

The mating profiles 18A and 18B may be pressed or forced together by the user to join or interlock to provide a closed bag. Alternatively, the mating profiles 18A and 18B are not joined but are left open to provide an open-mouth bag to the user.

The sealed edges 31 curve and extend outwardly from the perpendicular side seal 19. The end of the tails is defined by sealed side edges 30 and extends perpendicularly to the open mouth of the bag. Note that the structural shape of the panels 15 and 16 is arranged such that the mating profiles 18A and 18B are formed on portions of the panels 15 and 16 which extend outwardly and provide the tie tails 25 and 26.

The bags 11 are formed from the associated sheets on an adjacent or reversed side-by-side positioning. Thus each bag 11 is formed contiguous to, but relatively reversed in position, to the two adjacent bags. This eliminates any waste of sheet material. Also, a single sealing, scoring and/or severing operation provides sides 19 and 20 of adjacent bags, the outwardly extending tie portions 25 and 26 and the bottoms 24.

The bags include suitable holes 37 adjacent the open edges 35 so that the bags can be suitably stacked on associated stacking pegs and for subsequent mounting on convenient hangers for use.

FIG. 7 shows the panels 15A of another embodiment of the inventive bag 11A which is frusto-conical in configuration. Note that the bags are otherwise similar to the bags of FIGS. 3 and 4; and more particularly, the bags of FIG. 7 also include the tie tails 25 and 26 as well as the mating profiles 18A and 18B.

In one application, the packer may receive the bag 11 with the mouth of the bag open. The packer then fills the bag with produce and next, ties the bag as indicated in FIG. 1. When the customer gets the bag, she will open the bag to take out grapes, and the customer may then elect to close the mating profiles, as as is known and indicated in FIG. 2, to retain the remaining grapes in the bag. Thus the customer can conveniently open and reclose the bag when using grapes from the bag. In other instances, the mating profiles may be closed or interlocked by the packer when the grapes are packed intially.

FIG. 8 shows another embodiment of the inventive bag 11B in which one panel 16A is configured to have vertical slits 21A and is affixed to panel 15A which has horizontal slits 21, as in FIG. 3. Slit pattern 21A of panel 16A will open in a horizontal direction to receive the contents and conform closely to the contents placed adjacent thereto, but will not stretch or open in a vertical direction. As mentioned above, slit pattern 21 will open only in a vertical direction, and slit pattern 21A will open only in a horizontal direction. By the indicated construction, each of the panels 15 and 16A will cooperate to limit the opening of the slits of the other panel. Thus the overall bag 11 will retain its enclosing strength and still provide maximum ventilation to the contents of the bag.

In the embodiment of the invention shown in FIG. 8, the mating profiles 18A and 18B, such as shown in FIGS. 3 and 4, are omitted.

Note also that the inventive bag may be formed with a solid panel and the vertically slit panel similar to 16A, or the inventive bag may be formed with two solid panels 16 affixed to one another, all this without departing from the spirit of the invention.

While the invention has been particularly shown and described with reference to a preferred embodiment thereof, it will be understood by those skilled in the art that various changes in form and details may be made therein without departing from the spirit and scope of the invention.

I claim:

1. A plastic bag including two panels of pliable plastic film heat sealed along the periphery to define a body portion, a closed bottom and substantially parallel sides and having an open top, said open top of said bag being of relatively wider diameter than said body portion, portions of said panels extending outwardly from said sides adjacent the upper edges of said sides to define integral ties on opposite sides of said opening.

2. A plastic bag as defined in claim 1, in which one of said panels has a rib spaced from said open top and the other of said panels has a groove aligned with and receiving said rib to seal said open top.

3. A plastic bag as defined in claim 1 wherein said bag top portions and said tie portions are adapted to have elements such as holes and profiles.

4. A packaging means comprising opposed panels having peripheral edges sealed to each along the bottom and sides thereof to form a body portion and having an open top, said panels having portions adjacent said open top to define ties for closing said open top, and said ties being peripherally sealed and forming an integral extension of the seal of said sides and flaring outwardly beyond said sides for reinforcing said open top and making the diameter of said open top larger than the diameter of said body portion.

5. A method of making plastic bags, each having a closed bottom and an open top comprising an openable, reclosable mouth, consisting of the steps.

(a) providing two elongated sheets of plastic film having longitudinally extending mating profiles formed adjacent opposite edges of one surface of each of said sheets, (b) overlaying said two sheets of said plastic film, and (c) sealing said sheets to form opposed panels comprising the sides of said bag with alternate ones of said bags having their top formed along opposite edges of said sheets, and the bottoms spaced from the edges of said sheets.

6. A method as in claim 5 further including the step of (a) forming said bags to include portions of said panels extending outwardly of the side of the bag adjacent the top of one bag and toward the bottom of the adjacent bag and forming said profiles to have a section thereof on the extending portions of said panels.

7. A method as in claim 5 wherein the plastic bags include tongue and groove mating profiles formed adjacent the top, and step (b) includes the substep of aligning the tongue profilie of one sheet with the groove profile of the other sheet.

8. A method of making plastic bags including two panels of pliable plastic film heat sealed along the periphery to define a body portion with a closed bottom and substantially parallel sides and having an open top, consisting of the steps of:

(a) providing two elongated sheets of plastic having opposite substantially parallel edges and adapted to be moved longitudinally, (b) overlaying said two sheets, one on the other, lines substantially normal to said edges to define said body portions of said bags, with adjacent bags being formed to be in relatively top and bottom reversed positions.

(d) sealing said sheets to form bag portions extending outwardly from said body portions adjacent said open tops to form integral tie portions on opposite sides of said bag opening, (e) sealing tie portions of every other bag along substantially the same line normal to said edges, and (f) providing uninterrupted bag portions adjacent said bag top and said tie portions along both said parallel edges whereby elements such as holes and profiles can be formed along said bag top portions and tie portions.

* * * * *